US006933266B2

(12) United States Patent
Gupta

(10) Patent No.: US 6,933,266 B2
(45) Date of Patent: Aug. 23, 2005

(54) EFFERVESCENT CLEANING COMPOSITION FOR USE IN FABRIC WASHING

(75) Inventor: Neeraj Gupta, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/853,327

(22) Filed: May 25, 2004

(65) Prior Publication Data

US 2004/0242448 A1 Dec. 2, 2004

(51) Int. Cl.[7] ..... C11D 3/18; C11D 9/00

(52) U.S. Cl. ..... 510/342; 510/276; 510/279; 510/316; 510/353

(58) Field of Search ..... 510/276, 279, 510/316, 342, 353

(56) References Cited

U.S. PATENT DOCUMENTS

| | | | | | |
|---|---|---|---|---|---|
| 3,929,680 | A | | 12/1975 | Arai et al. | 252/542 |
| 3,947,567 | A | | 3/1976 | Berg, Jr. et al. | 424/45 |
| 4,180,467 | A | | 12/1979 | Barth | 252/99 |
| 4,406,708 | A | | 9/1983 | Hesselgren | 134/37 |
| 4,436,720 | A | | 3/1984 | Pakhomov et al. | 424/44 |
| 4,726,944 | A | * | 2/1988 | Osipow et al. | 510/120 |
| 4,772,427 | A | * | 9/1988 | Dawson et al. | 510/158 |
| 4,871,530 | A | * | 10/1989 | Grollier et al. | 424/47 |
| 5,326,556 | A | * | 7/1994 | Barnet et al. | 424/73 |
| 5,334,325 | A | * | 8/1994 | Chaussee | 424/43 |
| 5,500,211 | A | * | 3/1996 | George et al. | 424/73 |
| 5,514,302 | A | * | 5/1996 | Brown | 510/280 |
| 5,602,091 | A | * | 2/1997 | Monson et al. | 510/406 |
| 5,648,326 | A | * | 7/1997 | Sramek | 510/284 |
| 5,858,343 | A | * | 1/1999 | Szymczak | 424/73 |
| 5,866,524 | A | * | 2/1999 | Wevers | 510/279 |
| 5,981,459 | A | * | 11/1999 | Verbiest et al. | 510/279 |
| 6,004,920 | A | | 12/1999 | Pollack et al. | 510/426 |
| 6,096,702 | A | * | 8/2000 | Ramirez et al. | 510/421 |
| 6,106,817 | A | * | 8/2000 | Ramirez et al. | 424/70.19 |
| 6,440,912 | B2 | * | 8/2002 | McGee et al. | 510/140 |
| 6,682,726 | B2 | * | 1/2004 | Marchesi et al. | 424/73 |
| 6,803,032 | B2 | * | 10/2004 | McCaulley et al. | 424/73 |

FOREIGN PATENT DOCUMENTS

| | | |
|---|---|---|
| EP | 820 755 | 1/1998 |
| EP | 918 087 | 5/1999 |
| WO | 86/02832 | 5/1986 |
| WO | 90/11343 | * 10/1990 |
| WO | 97/25408 | * 7/1997 |
| WO | 98/04671 | 2/1998 |
| WO | 98/35011 | 8/1998 |

OTHER PUBLICATIONS

European Search Report in an EP application EP 03 25 3318.
Derwent Abstract of WO 96/35011 —published Aug. 13, 1998.
Derwent Abstract of EP 918 087 —published May 26, 1999.

* cited by examiner

*Primary Examiner*—Charles Boyer

(57) ABSTRACT

The present invention provides an aqueous effervescent liquid detergent composition which upon contact with water provides effervescent action, and which comprises at least 5% by weight of a surfactant and from 0.1 to less than 3% by weight of a volatile organic solvent selected from pentane, hexane, cyclohexane and diethylether. Said solvent is present in sufficient amount to provide the effervescent action, and has a higher solubility in an aqueous surfactant-containing composition than in water, the boiling point of said solvent being lower than the typical temperature during the washing process.

7 Claims, No Drawings

EFFERVESCENT CLEANING COMPOSITION FOR USE IN FABRIC WASHING

FIELD OF THE INVENTION

The present invention relates to an effervescent cleaning composition which upon contact with water provides an effervescent and cleaning effect. In particular, the invention relates to an effervescent detergent composition for use in fabric washing.

The invention also relates to a process for cleaning articles, in particular fabric articles, whereby an effervescent action is provided by employing effervescent cleaning composition of the present invention.

BACKGROUND OF THE INVENTION

The development and formulation of effervescent compositions has traditionally been focussed on the use of various constituents for obtaining in situ chemical reactions upon contact with water, so as to form a gas to provide effervescent action.

This type of acid/base reaction systems has for instance been disclosed in U.S. Pat. Nos. 4,180,467, 4,406,708, and 4,436,720. The cleansing benefit derived from the effervescent action has been well documented in these prior art patent documents.

Furthermore, it is known in the art that effervescent action can be applied for promoting rapid release of detergents into the wash liquor so as to provide favourable cleaning performance. In this connection, several solution involving effervescent systems have been proposed to try and avoid problems of poor dissolution and dispensing behaviour.

For example, in WO-98/04671 effervescent systems for use in detergents are disclosed in which, in an effort to improve dissolution, acid and alkaline reactants which react upon contact with water to produce a gas, are mixed with a stabilising agent, so as to produce a substantially anhydrous effervescent particle for use in a washing cycle. Similarly, WO-98/35011 discloses particles comprising sodium bicarbonate and organic acid reactants which react together and which are formed into a particle by using a binder.

Furthermore, EP-A-918,087 refers to co-builder particles for use as additive in detergent compositions, comprising bicarbonate and polycarboxylic acid which are formed by roller compaction and which contain no free moisture.

Another way of providing effervescent action is disclosed in U.S. Pat. No. 3,947,567. In this document, a method of providing an effervescent mouth wash is disclosed, wherein a liquefied gas is distributed under pressure in an aerosol dispensing container.

WO-86/02832 discloses yet another way to provide effervescence to anhydrous compositions when these are contacted with water. In this document, effervescent compositions are disclosed, comprising an essentially anhydrous base medium and inorganic oxide material containing an adsorbed gas, e.g. carbon dioxide. This gas may be any gas capable of being adsorbed by the inorganic oxide material in sufficient amounts to provide effervescent action upon contact with water.

However, the technology applied in the above-described effervescent systems cannot be used for aqueous liquid cleaning compositions without incurring considerable problems. A main reason is that incorporation of reactants which react on contact with water to produce a gas, into such an aqueous liquid would lead to immediate reaction and that this immediate reaction can only be avoided by segregating these reactants, e.g. by encapsulating them, which would entail considerable cost. Furthermore, the technology disclosed in U.S. Pat. No. 3,947,567 and WO-86/02832 cannot be suitably used in aqueous cleaning systems.

It follows that there is still a need for providing an effervescent aqueous liquid cleaning composition especially for use in fabric washing, which produces adequate effervescent action when contacted with water and of which the manufacturing cost is moderate.

Consequently, an object of the present invention is to provide such an effervescent aqueous liquid cleaning composition.

It is another object of the invention to provide an effervescent aqueous liquid cleaning composition which is easy to produce at affordable cost and which gives a consumer perceivable benefits.

It has now surprisingly been found that these and other objects can be achieved when applying the effervescent aqueous cleaning composition of the present invention.

DEFINITION OF THE INVENTION

Accordingly, in one aspect the present invention provides an aqueous effervescent liquid detergent composition which upon contact with water provides effervescent action, and which comprises at least 5% by weight of a surfactant and from 0.1 to less than 3% by weight of a volatile organic solvent selected from the group consisting of pentane, hexane, cyclohexane, and diethylether, said solvent being present in sufficient amount to provide the effervescent action and having a higher solubility in an aqueous surfactant-containing composition than in water and the boiling point of said solvent being lower than the typical temperature during the washing process.

In another aspect the invention provides a process for cleaning articles, especially fabric articles, whereby an effervescent action is provided by employing an aqueous effervescent liquid cleaning composition of the invention.

DETAILED DESCRIPTION OF THE INVENTION

The present invention relates to an aqueous effervescent liquid cleaning composition which provides effervescent action upon contact with water.

It has been found that the aqueous effervescent cleaning composition of the invention can be prepared in a simple way and that the preparation cost is moderate.

Furthermore, no reactive ingredients need to be applied for obtaining the effervescent effect and types of volatile organic solvents can be used which actively contribute to the cleaning performance after addition to the wash liquor.

Furthermore, the effervescent action of the composition of the invention in the wash liquor will not only contribute to the cleaning performance but it will also provide a consumer perceivable sensation of cleaning.

The aqueous effervescent liquid cleaning composition of the invention contains effectively at least 10% by weight of water, the water content being preferably in the range of from 20 to 90% by weight.

This aqueous effervescent cleaning composition may generally be any aqueous liquid composition. It may be either an isotropic or a structured liquid composition and it may optionally contain suspended particles. However, the composition of the invention is preferably an isotropic liquid detergent composition for use in fabric washing.

The aqueous liquid composition of the invention is preferably maintained in a non-pressurized container, i.e. a container wherein the pressure does not exceed 50 mbarg. A suitable container may be a plastic container, such as a bottle made of polyethylene, polypropylene, polyvinylchloride or polyethylene terephthalate.

The Volatile Organic Solvent

The volatile organic solvent according to the invention has a higher solubility in an aqueous surfactant system than in water. Furthermore, the boiling point of said solvent is lower than the typical temperature at which a washing process is carried out.

The volatile organic solvent is present in the composition of the invention in a sufficient amount to provide the effervescent action upon contact with water. The solvent is present in the composition at a concentration of from 0.1 to less than 3% by weight, preferably from 0.1 to 2% by weight.

The boiling point of the volatile organic solvent is preferably lower than 90° C., more preferably lower than 60° C. The volatile organic solvent is selected from the group consisting of pentane, hexane, cyclohexane, and diethyl ether. Preferably, the volatile organic solvent is pentane or diethyl ether.

Since some of the volatile organic solvent of the invention may evaporate during storage, it may be desirable to use non-permeable packaging material and air-tight bottles for the liquid composition of the invention. For the same reason, it is desirable to use a gas which is heavier than air as dissolved gas, in order to keep most of it in the air tight bottle after it has been opened.

The Surfactant

The surfactant is present in the composition of the invention at a concentration of at least 5% by weight, preferably from 5 to 70% by weight, a concentration of 10 to 50% by weight being more preferred.

The surfactant may generally be any type of surfactant, such as a nonionic, an anionic, a cationic, or a zwitterionic surfactant. Combinations of surfactant are also suitable for use in the composition of the present invention. Preferred types of surfactant are anionic, nonionic and cationic surfactants.

Anionic Surfactant

The anionic surfactant that may be used, is preferably selected from the group consisting of linear alkyl benzene sulphonates, alkyl sulphonates, alkyl polyether sulphates, alkyl sulphates and mixtures thereof.

The linear alkyl benzene sulphonate (LAS) materials and their preparation are described for example in U.S. Pat. Nos. 2,220,099 and 2,477,383, incorporated herein by reference. Particularly preferred are the sodium, potassium and mono-, di-, or tri-ethanolamminium linear straight chain alkylbenzene sulphonates in which the average number of carbon atoms in the alkyl group is from 11 to 14. Sodium salt of C11–C14, e.g. C12, LAS is especially preferred.

Preferred anionic surfactants also include the alkyl sulphate surfactants being water soluble salts or acids of the formula ROSO3M, wherein R preferably is a C10–C24 hydrocarbyl, preferably an alkyl or hydroxyalkyl having a C10–C18 alkyl group, more preferably a C12–C15 alkyl or hydroxyalkyl, and wherein M is H or a cation, e.g. an alkali metal cation (e.g. sodium, potassium, lithium), or ammonium or substituted ammonium, especially mono-, di-, or tri-ethanolammonium. Most preferably, M is sodium.

Further preferred anionic surfactants are alkyl sulphonates, and desirably those in which the alkyl groups contain 8 to 26 carbon atoms, preferably 12 to 22 carbon atoms, and more preferably 14 to 18 carbon atoms.

The alkyl substituent is preferably linear, i.e. normal alkyl, however, branched chain alkyl sulphonates can be employed, although they are not as good with respect to biodegradability. The alkyl substituent may also be terminally sulphonated or may be joined to any carbon atom on the alkyl chain, i.e. may be a secondary sulphonate. The alkyl sulphonates can be used as the alkali metal salts, such as sodium and potassium. The preferred salts are the sodium salts. The preferred alkyl sulphonates are the C10 to C18 primary normal alkyl sodium sulphonates.

Also, alkyl polyether sulphates are preferred anionic surfactants for use in the composition of the invention. These polyether sulphates may be normal or branched chain alkyl and contain lower alkoxy groups which can contain two or three carbon atoms. The normal alkyl polyether sulphates are preferred in that they have a higher degree of biodegradability than the branched chain alkyl, and the alkoxy groups are preferably alkoxy groups.

The preferred alkyl polyethoxy sulphates used in accordance with the present invention are represented by the formula:

$$R1\text{-}O(CH2CH_2O)p\ \text{-}SO3M,$$

wherein:

R1 is C8 to C20 alkyl, preferably C12 to C15 alkyl;

p is 2 to 8, preferably 2 to 6, and more preferably 2 to 4;

and M is an alkali metal, such as sodium and potassium, or an ammonium cation. The sodium salt is preferred.

The surfactant for use in the composition of the invention may also be a fatty acid or a fatty acid soap.

The fatty acids include saturated and non-saturated fatty acids obtained from natural sources and synthetically prepared. Examples of fatty acids include capric, lauric, myristic, palmitic, stearic, oleic, linoleic and linolenic acid.

Nonionic Surfactant

The surfactant material in the effervescent liquid composition of the invention may also be a nonionic surfactant. Nonionic detergent surfactants are well-known in the art. They normally consist of a water-solubilizing polyalkoxylene or a mono- or d-alkanolamide group in chemical combination with an organic hydrophobic group derived, for example, from alkylphenols in which the alkyl group contains from about 6 to about 12 carbon atoms, dialkylphenols in which primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylene. Also common are fatty acid mono- and dialkanolamides in which the alkyl group of the fatty acidradical contains from 10 to about 20 carbon atoms and the alkyloyl group having from 1 to 3 carbon atoms. In any of the mono- and di-alkanolamide derivatives, optionally, there may be a polyoxyalkylene moiety joining the latter groups and the hydrophobic part of the molecule. In all polyalkoxylene-containing surfactants, the polyalkoxylene moiety preferably consists of from 2 to 20 groups of ethylene oxide or of ethylene oxide and propylene oxide groups. Amongst the latter class, particularly preferred are those described in European specification EP-A-225,654. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide.

Builders

Builders which can be used in the composition according to the present invention include conventional alkaline detergent builders, inorganic or organic, which can be used at levels of from 0% to 50% by weight of the composition, preferably from 1% to 35% by weight.

Examples of suitable inorganic detergency builders that may be used are water soluble alkali metal phosphates, polyphosphates, borates, silicates, and also carbonates. Specific examples of such builders are sodium and potassium triphosphates, pyrophosphates, orthophosphates, hexametaphosphates, tetraborates, silicates, and carbonates.

Examples of suitable organic detergency builders are: (1) water-soluble amino polycarboxylates, e.g. sodium and potassium ethylenediaminetetraacetates, nitrilotriacetates and N-(2 hydroxyethyium and potassium salts of ethane-1-hydroxy-1,1-diphosphonic acid; sodium and potassium salts of methylene diphosphonic acid; sodium and potassium salts of ethylene diphosphonic acid; and sodium and potassium salts of ethane-1,1,2-triphosphonic acid.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, and tartrate disuccinate.

Desirably, the detergency builder is selected from the group consisting of carboxylates, polycarboxylates, aminocarboxylates, carbonates, bicarbonates, phosphates, phosphonates and mixtures thereof.

Amorphous and crystalline zeolites or aluminosilicates can also be suitably used as detergency builder in the effervescent composition of the invention.

Enzymes

When the composition of the invention is used for fabric washing, it may suitably contain enzymes.

Suitable enzymes for use in the present invention include proteases, amylases, lipases, cellulases, peroxidases, and mixtures thereof, of any suitable origin, such as vegetable, animal bacterial, fungal and yeast origin. Preferred selections are influenced by factors such as pH-activity, thermostability, and stability to active bleach detergents, builders and the like. In this respect bacterial and fungal enzymes are preferred such as bacterial proteases and fungal cellulases.

Enzymes are normally incorporated into detergent composition at levels sufficient to provide a "cleaning-effective amount". The term "cleaning effective amount" refers to any amount capable of producing a cleaning, stain removal, soil removal, whitening, or freshness improving effect on the treated substrate. In practical terms for normal commercial operations, typical amounts are up to about 5 mg by weight, more typically 0.01 mg to 3 mg, of active enzyme per gram of detergent composition.

Stated otherwise, the composition of the invention may typically comprise from 0.001 to 5%, preferably from 0.01 to 1% by weight of a commercial enzyme preparation.

Other Optional Components

Alkaline buffers may be optionally added to the composition of the invention, including monethanolamine, triethanolamine, borax, and the like.

There may also be included in the formulation, minor amounts of soil suspending or anti-redeposition agents, e.g. polyvinyl alcohol, fatty amides, sodium carboxymethyl cellulose or hydroxy-propyl methyl cellulose.

Optical brighteners for cotton, polyamide and polyester fabrics, and anti-foam agents may also be used.

Other optional ingredients which may be added in minor amounts, are soil release polymers, dye transfer inhibitors, polymeric dispersing agents, suds suppressors, dyes, perfumes, colourants, filler salts, anti-fading agents and mixtures thereof.

Preparation Method

The effervescent liquid composition of the invention may be effectively prepared by simply mixing the organic solvent into the detergent liquid at an appropriate stage during the processing of the liquid composition.

The invention will now be illustrated with reference to the following example, in which parts and percentages are by weight.

EXAMPLE 1

An aqueous effervescent liquid detergent formulation was prepared having the following composition:

| Ingredient | % wt |
|---|---|
| Nonionic surfactant | 14.0 |
| Fatty acid | 8.0 |
| SLES 3EO | 10.0 |
| Propylene glycol | 4.0 |
| Sodium hydroxide | 2.0 |
| Sodium chloride | 2.0 |
| Boric acid | 1.0 |
| Phosphonate | 1.0 |
| Minors (including perfume, dye, PVP, fluorescer, preservative) | 0.9 |
| Pentane | 1.0 |
| Water | 56.1 |

The pentane organic solvent was incorporated into the effervescent composition while mixing the other ingredients with each other.

This formulation showed favourable visual appearance of effervescence when contacted with excess water.

What is claimed is:

1. An aqueous isotropic effervescent liquid detergent composition for use in fabric washing which upon contact with wash liquor provides effervescent action, and which comprises from 1 to 35% of a builder selected from the group consisting of water soluble alkali metal phosphates, polyphosphates, borates, silicates, carbonates; polycarboxylates; water-soluble salts of phytic acid; water-soluble polyphosphonates; water-soluble salts of mellitic acid; carboxymethyloxysuccinic acid, salts of polymers of itaconic acid and maleic acid, tartrate monsuccinate, and tartrate disuccinate; amorphous and crystalline zeolites or aluminosilicates, at least 5% by weight of a surfactant including fatty acid soap and from 0.1 to less than 3% by weight of a volatile organic solvent selected from the group consisting of pentane, hexane, cyclohexane and diethylether, said solvent being present in sufficient amount to provide the effervescent action in the wash liquor and having a higher solubility in an aqueous surfactant-containing composition than in water, and the boiling point of said solvent being lower than the typical temperature during the washing process.

2. A composition according to claim 1, wherein said composition is contained in a non-pressurized container.

3. A composition according to claim 1, wherein the boiling point of the volatile organic solvent is lower than 90° C., preferably lower than 60° C.

4. A composition according to claim 1, wherein the volatile organic solvent is pentane or diethyl ether.

5. A composition according to claim 1, wherein the volatile organic solvent is present at a concentration of from 0.1 to 2% by weight.

6. A composition according to claim 1, wherein the surfactant is present at a concentration of from 5 to 70% by weight.

7. Fabric washing process for cleaning articles, whereby an effervescent action is provided upon contact with wash liquor by employing an aqueous effervescent liquid cleaning composition according to claim 1.

* * * * *